US005562149A

United States Patent [19]

Banušić

[11] Patent Number: 5,562,149

[45] Date of Patent: Oct. 8, 1996

[54] VACUUM CASTING APPARATUS

[76] Inventor: Bane Banušić, Grubenstrasse 72, CH-3322 Schönbühl, Switzerland

[21] Appl. No.: 274,013

[22] Filed: Jul. 12, 1994

[30] Foreign Application Priority Data

Jul. 13, 1993 [CH] Switzerland ..... 02-096/93

[51] Int. Cl.[6] ..... B22D 37/00

[52] U.S. Cl. ..... 164/258; 164/337; 222/591; 266/208

[58] Field of Search ..... 164/256, 258, 164/337, 65, 68.1, 61, 66.1, 133; 222/591, 606; 266/208, 211, 236

[56] References Cited

U.S. PATENT DOCUMENTS 2,882,570 4/1959 Brennan ..... 164/256
3,226,102 12/1965 Pagonis ..... 164/65
4,478,270 10/1984 Rosenthal et al. ..... 164/254
5,062,470 11/1991 Rikker ..... 164/61

*Primary Examiner*—Joseph J. Hail, III
*Assistant Examiner*—Randolph S. Herrick
*Attorney, Agent, or Firm*—Marks & Murase L.L.P.

[57] ABSTRACT

A casting conduit (5) is attached at a low-level location to a completely sealable furnace (1) for a casting material (2). At this connection, the furnace is provided with an outlet opening (4) which is capable of being closed by a shutter (3). The casting conduit (5) leads down to a mold chamber (6) in which the mold (7) is located. The casting conduit (5) is closed, e.g. in the manner of a tube, and can be connected by a vacuum connection (8) to a vacuum installation together with the mold chamber (6). When the vacuum in the furnace (1) and in the casting conduit (5) resp. the mold chamber (6) is equivalent, the outlet opening (4) can be opened by means of the shutter (3), and the casting material (3) can flow into the mold chamber (6) and into the mold (7) via the casting conduit (5).

6 Claims, 1 Drawing Sheet

VACUUM CASTING APPARATUS

BACKGROUND OF THE INVENTION

The present invention refers to a casting apparatus, more particularly for casting metals under strongly reduced pressure or in a protective gas.

The casting of metals under strongly reduced pressure or vacuum serves to prevent gas inclusions in the cast material and between the cast material and the casting mold. It is also possible under vacuum or in a protective gas to melt air-sensitive materials and pour them in molds.

In known methods, a required quantity of the casting material and the casting mold are placed in a vacuum chamber and the casting is carried out. In an alternative embodiment for large-scale industrial applications, the mold is located in a second, separate vacuum chamber. For the casting, the mold is transferred through a sealable opening to the chamber in which the liquid casting material is held in a container which is suitable for the casting operation. The casting material is poured into the mold, and the mold is brought back to the second chamber.

In this case it is advantageous that the melting and the exchange of the casting mold can be effected independently from each other. Disadvantageous, however, are the complications involved in the transport of the casting molds, the connecting opening between the two chambers, which limits the size of the molds, as well as the pivoting mechanism of the container for the casting material which is necessary for the casting operation.

SUMMARY OF THE INVENTION

It is an object of the present invention to provide a simplified apparatus for vacuum casting.

This object is achieved by an apparatus for vacuum casting comprising a furnace for melting the casting material which is used for the casting, wherein a mold chamber is connected to the furnace by a closed casting conduit, wherein the casting conduit is connected to the furnace at a low-level junction location thereof, and wherein an opening is provided at said junction of the furnace which is provided with a closure allowing to open and close the opening. Preferred embodiments are defined in the dependent claims.

Thus, the apparatus of the present invention is provided with a closed conduit, e.g. in the manner of a tube, which leads from the furnace for the casting material down to the mold chamber where the casting mold is located during the casting operation. The conduit is connected at a low-level location to the furnace, in such a manner that ideally the entire contents of the furnace can be delivered to the casting mold through an outlet opening at this location and by the conduit.

The outlet opening is provided with an externally controllable shutter, such as e.g. a gate, whose cross-section is preferably significantly smaller than that of the conduit.

BRIEF DESCRIPTION OF THE DRAWING

The invention shall be further explained by way of a preferred embodiment with reference to the single drawing.

DETAILED DESCRIPTION OF THE PREFERRED EMBODIMENT

Figure 1:
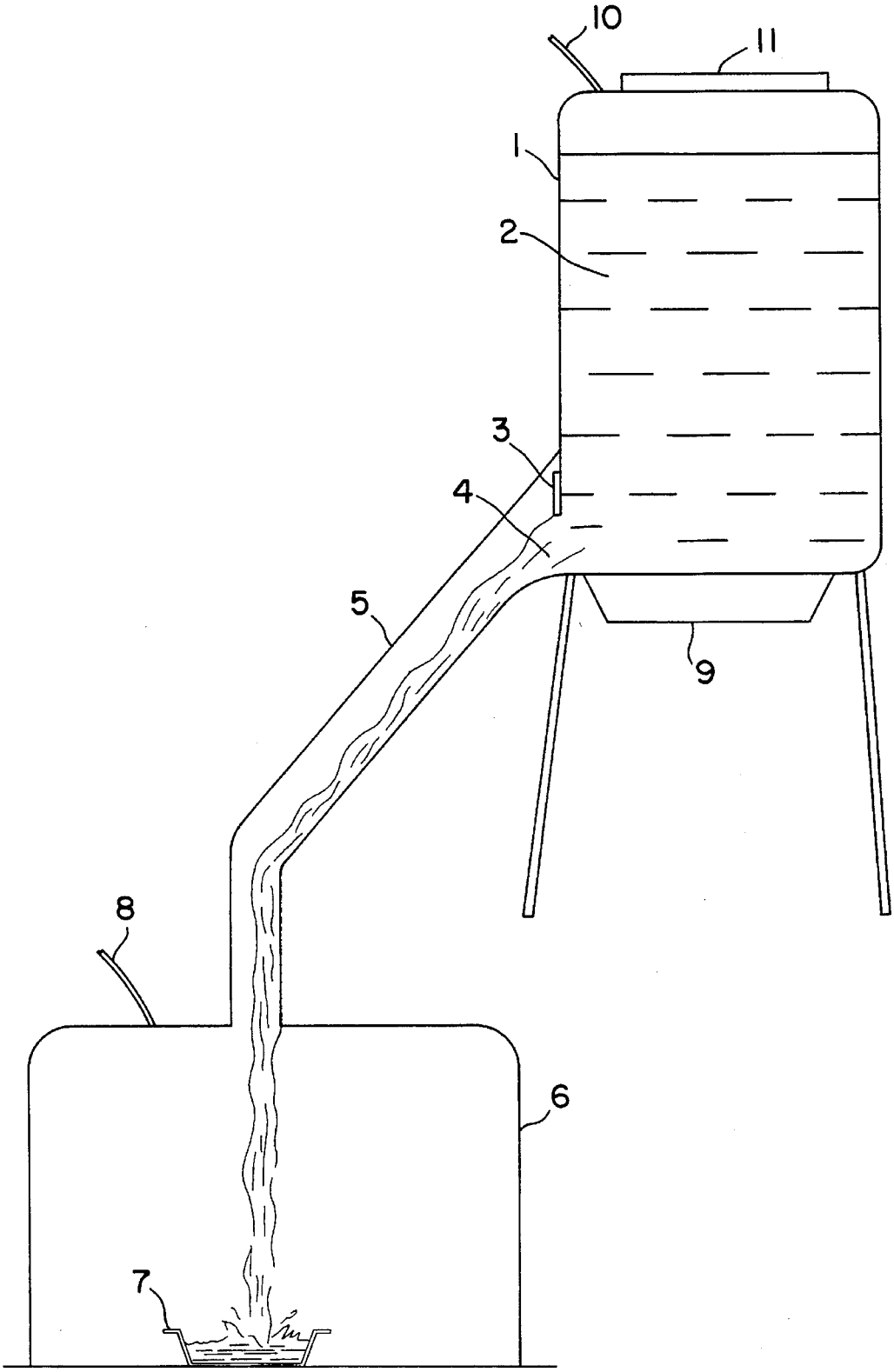
FIG. 1 is a cut-away side view of the vacuum casting apparatus of the present invention.

Furnace 1, which is capable of being completely sealed, is provided with a heating element 9, a sealable opening 11 for the supply of the casting material in a solid form, e.g. in the form of a granulate or of ingots, as well as with a connection to a vacuum installation 10. Outlet 4, to which conduit 5 is attached, is provided at the bottom of furnace 1. Outlet 4 is capable of being closed by means of gate 3. Its open position in the course of a casting operation is shown.

Casting conduit 5 leads from furnace I down to mold chamber 6 where mold 7 is located during the casting operation. Furthermore, mold chamber 6 is provided with a connection 8 to said vacuum installation. Due to the level difference between furnace 1 and mold chamber 6, the liquid casting material 2 may flow into the mold chamber and to the correspondingly placed casting mold 7 by conduit 5 under the effect of gravity if the vacuum in mold chamber 6 and in furnace 1 is equivalent.

In a preferred embodiment, the cross-section of conduit 5 is selected to be larger than the cross-section of opening 4, so that the casting material can flow freely in conduit 5 and conduit 5 will be completely drained when gate 3 has been closed. The mold chamber end of casting conduit 5 is preferably designed in such a manner that a directed filling of a mold 7 is ensured. Besides being shaped as a pouring nozzle, the end portion may also be intended for an attachment of pouring adapters for pouring characteristics of the casting material which characteristics are adapted to the respective mold, e.g. for casting molds having several filling openings.

In order to enter and remove the casting molds 7, casting chamber 6 is either provided with a sealable opening, or the entire chamber is capable of being opened in a known manner which is not represented in detail. It may, e.g., be formed by a bipartite bell jar which is provided with an opening having sealing elements for conduit 5 and rests on a basement. Another possibility is that the base of mold chamber 6, which supports the casting molds 7, is downwardly removable after ventilation via connection 8.

Further modifications of the invention are accessible to those skilled in the art from the description without leaving the scope of the invention. On account of its simplicity, applications of the invention are possible in the field of jewellery or dental technique, but also in large-scale industry.

In the following description of a casting operation, which serves as an example, it is assumed that the furnace has been supplied with casting material and that the casting material has been melted. Furnace 1 is under a vacuum which has been established by evacuating air via connection 10. A casting mold is entered into mold chamber 6. Mold chamber 6 is closed and vacuum is applied. As soon as the vacuum in mold chamber has at least approximately attained the quality of the vacuum in furnace 1, opening 4 is opened by actuating gate 3, and a quantity of the casting material 2 corresponding to the volume of casting mold 7 is let out of furnace 1. Opening 4 is closed again, and the casting material 2 which is still in conduit 5 flows from conduit 5 into casting mold 7 nearly completely due to the enlarged volume of conduit 5.

The apparatus of the invention is also applicable for casting operations in protective gas, more particularly in the embodiment having a casting conduit 5 which is enlarged with respect to the opening 4, preferably a pressure compensation having to be provided, however, in the furnace 1 and, depending on the volume, in the mold chamber 6 as well, in order to ensure a free outflow from the furnace.

I claim:

1. An apparatus for vacuum casting, comprising a furnace for melting a casting material which is used for casting, wherein a mold chamber with means for receiving a casting mold therein is connected to said furnace by a closed casting conduit, wherein said casting conduit is connected by a junction to a lower portion of said furnace and a chamber end of said casting conduit is positioned to direct casting material from said furnace into said mold chamber, wherein an opening is provided at said connection of said furnace and said casting conduit, said opening being provided with a shutter device for opening and closing said opening, wherein said casting conduit is in direct fluid communication with said mold chamber and has a larger cross-section than said opening, wherein at least said furnace, said casting conduit and said mold chamber are designed for a vacuum applicable in vacuum casting, and further comprising means for creating a vacuum pressure in said furnace, said casting conduit and said mold chamber.

2. The apparatus of claim 1, wherein at least said furnace, said casting conduit and said mold chamber are sealed in a largely gastight manner and at least portions of the apparatus on the furnace side and on the mold chamber side have at least a connection for ventilation and for air evacuation each.

3. The apparatus of claim 1, wherein said opening is sealable in a largely gastight manner by said shutter device.

4. The apparatus of claim 1, wherein said mold chamber is provided with a sealable opening in order to be able to insert said casting mold into said mold chamber.

5. The apparatus of claim 1, wherein said shutter is controllable from outside.

6. An apparatus for vacuum casting, comprising:

a furnace for melting a casting material used for casting;

a mold chamber with means for receiving a casting mold therein;

a casting conduit connecting said mold chamber to an outlet at a lower portion of said furnace, said casting conduit being positioned so as to direct casting material from said furnace into a casting mold within said mold chamber; and a shutter means provided at a junction between said casting conduit and said furnace for opening and closing said outlet, said casting conduit being in sealed communication with said mold chamber and having a larger cross-section than said outlet of said furnace whereby said casting conduit remains at the same vacuum pressure as said mold chamber; and means for creating a vacuum pressure in said furnace, said casting conduit, and said mold chamber.

* * * * *